US005958189A

United States Patent [19]

Begemann et al.

[11] Patent Number: 5,958,189

[45] **Date of Patent: *Sep. 28, 1999**

[54] WET PART OF A PAPER MAKING MACHINE

[75] Inventors: Ulrich Begemann; Dirk Thomas, both of Heidenheim, Germany

[73] Assignee: Voith Sulzer Papiermaschinen GmbH, Heidenheim, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/618,748

[22] Filed: Mar. 20, 1996

[30] Foreign Application Priority Data

Mar. 20, 1995 [DE] Germany ..... 195 09 522

[51] Int. Cl.[6] ..... D21F 1/66

[52] U.S. Cl. ..... 162/264; 162/183; 162/190; 162/298; 162/299; 162/322; 162/336; 162/338; 162/343

[58] Field of Search ..... 162/183, 190, 162/264, 322, 336, 338, 343, 298, 299

[56] References Cited

U.S. PATENT DOCUMENTS

| | | | |
|---|---|---|---|
| 3,296,066 | 1/1967 | Green et al. | 162/338 |
| 3,565,758 | 2/1971 | Higgins et al. | 162/336 |
| 4,021,295 | 5/1977 | Schmaeng | 162/264 |
| 4,387,003 | 6/1983 | Meinecke et al. | 162/336 |
| 4,477,313 | 10/1984 | Andersson | 162/190 |
| 5,316,383 | 5/1994 | Begemann et al. | 162/336 |
| 5,401,363 | 3/1995 | Begemann et al. | 162/164.6 |
| 5,505,819 | 4/1996 | De Witt et al. | 162/190 |
| 5,573,642 | 11/1996 | Begemann | 162/190 |
| 5,635,033 | 6/1997 | Grossmann et al. | 162/140 |

FOREIGN PATENT DOCUMENTS

| | | |
|---|---|---|
| 2109911 | 5/1994 | Canada . |
| 0 600 251 | 6/1994 | European Pat. Off. . |
| 42 37 309 | 4/1993 | Germany . |
| 42 39 647 | 6/1994 | Germany . |

OTHER PUBLICATIONS

European Search Report for Application No. EP 96 10 2508, mailed Nov. 26, 1997.

*Primary Examiner*—Peter Chin

*Attorney, Agent, or Firm*—Marshall, O'Toole, Gerstein, Murray & Borun

[57] ABSTRACT

A wet part of a paper making machine includes a distributor to which a main stream of a stock suspension is fed and which has a number of connections. The connections are connected by means of split stream lines to a machine-wide flow box which has a machine-wide slice nozzle (headbox). The split stream lines are connected (directly or indirectly) to the flow box. The slice nozzle is connected to at least one continuous web-forming screen. At least one collection trough is connected to the screen, as well as, optionally, to a backwater tank to accept the backwater trapped by the collection trough. Dilution water lines are provided to introduce backwater into the split stream lines to adjust the stock density of the split streams. The dilution water lines are connected directly to the collection trough.

4 Claims, 1 Drawing Sheet

WET PART OF A PAPER MAKING MACHINE

BACKGROUND OF THE INVENTION

1. Field of the Invention

The invention relates to apparatus for making paper, and in particular to a wet part or portion of a paper making machine.

2. Description of Related Technology

It is known to provide a wet part of a paper making machine with a distributor to which a main stream of a stock suspension is fed and which has a number of connections. The connections are connected by means of split stream lines to a machine-wide flow box which has a machine-wide slice nozzle (headbox). The split stream lines are connected (directly or indirectly) to the flow box. The slice nozzle is connected to at least one continuous web-forming screen. At least one collection trough is connected to the screen, as well as, optionally, to a backwater tank to accept the backwater trapped by the collection trough. Dilution water lines are provided to introduce backwater into the split stream lines to adjust the stock density of the split streams.

A particularly crucial component of such a wet part of a paper making machine is the flow box with the slice nozzle (the so-called headbox). This decisively determines the quality of the produced paper web.

The most important quality requirements concern fiber orientation in the pulp stream leaving the slice nozzle and in the paper web after its production, as well as the basis weight profile, i.e., the distribution of basis weight both lengthwise and across the machine direction of the paper web.

It has been possible, based on new developments, to bring the basis weight transverse profile under control in an outstanding fashion. This occurs by introducing dilution water into the split streams coming from the distributor.

Backwater, i.e., the water separated from the pulp during the sheet formation process, is preferably used as dilution water. This backwater is trapped in a collection trough, the so-called machine pit, from which it enters into a backwater tank of a relatively high volume. Use of backwater is more favorable for a variety of reasons than use of fresh water. It saves on fresh water. In addition, the valuable fibers and fillers contained in the backwater are reused. Connection lines are provided that make a connection between the backwater tank and the partial (split stream) flow lines to the flow box.

Maintaining a constant basis weight profile over the width of the paper web is possible based on the said modern development. However, it has been shown that the basis weight of the paper web does not remain constant over longer periods even with this principle of basis weight cross profile control. The reasons correspond essentially to those of conventional cross profile control. For example, the paper web deviates in basis weight with respect to hours of production. What changes then is the longitudinal (lengthwise or machine direction) profile of basis weight. The cross profile (transverse to the lengthwise or machine direction) can remain essentially constant.

There has been no lack of effort to determine the cause of this lack of constant basis weight profile and to overcome it. Thus, an attempt was made to solve the problem by means of control and supplying varying amounts of pulp and filler into the split stream lines during deviations. However, this was unsuccessful, insofar as the deviations in basis weight in the longitudinal direction had already occurred by the time they were recognized, so that the controlling intervention by appropriate supply of dilution water came too late. The period between occurrence of the disturbance and the corrective intervention is generally significant, since recording of reliable measured values is very time-intensive.

SUMMARY OF THE INVENTION

It is an object of the invention to overcome one or more of the problems described above. It also is an object of the invention to configure a wet part of a paper making machine so that basis weight fluctuations are largely suppressed.

A wet part of a paper making machine according to the invention includes a distributor, to which a main stream of stock suspension is fed, the distributor having a plurality of connections and a machine-wide flow box having a machine-wide headbox slice nozzle. A plurality of split stream lines each connect to one of the plurality of connections of the distributor and to the machine-wide flow box. The split stream lines are connected directly or indirectly to the flow box. The slice nozzle is connected to at least one web-forming screen. At least one collection trough is connected to the screen and optionally to a backwater tank through a line system for receiving backwater trapped by the collection trough. A plurality of dilution water lines for introducing backwater into the split stream lines to adjust the stock density of the split streams are connected directly to either the collection trough or the line system to the backwater tank.

According to another embodiment of a wet part of a paper making machine of the invention, the dilution water lines, the main stream line, and/or the split stream lines include connections for introducing chemicals, such as retention agents, or additional pulp suspensions and screened stock suspensions.

Other objects and advantages of the invention will be apparent to those skilled in the art from the following detailed description taken in conjunction with the drawings and the appended claims.

DETAILED DESCRIPTION OF THE INVENTION

Figure 1:
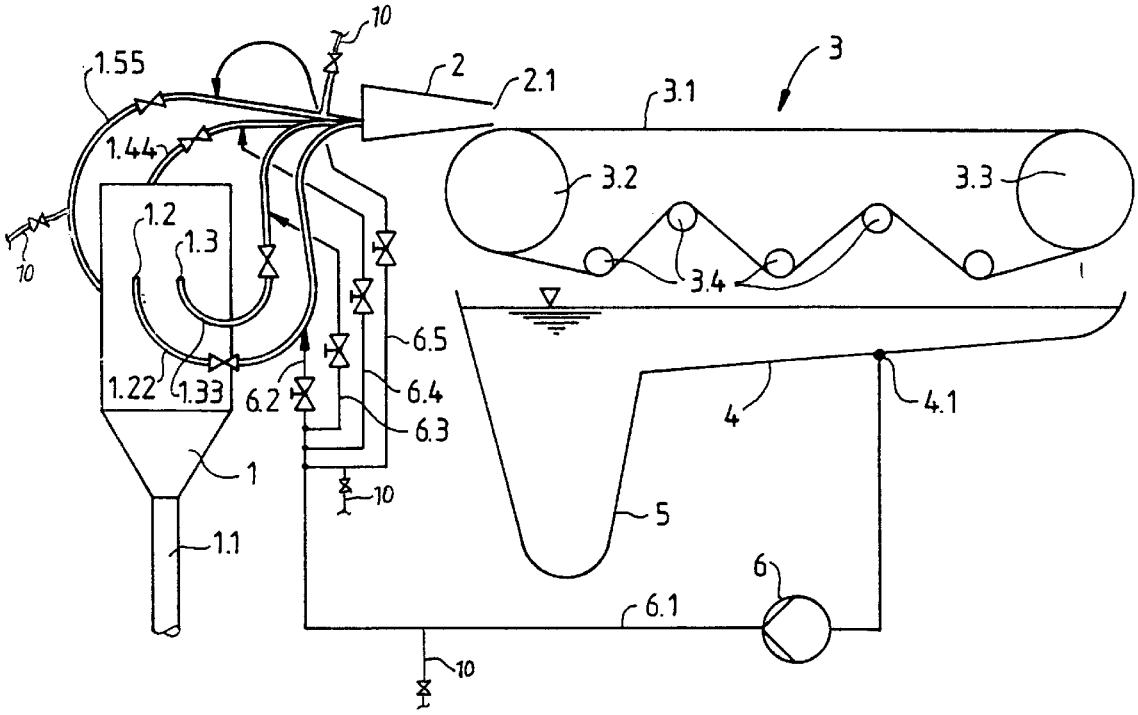
FIG. 1 is a partially schematic and cross-sectional view of an apparatus according to the invention.

The inventor recognized in particular the following: a limited fluctuation in the so-called retention of a forming paper sheet occurs especially in papers with high fines content or high finer content, as well as with high requirements on sheet formation during production. The term retention refers to the degree to which fines or fillers remain in the forming paper sheet and thus do not pass through the screen. However, such a fluctuation in the retention means a change in density of the backwater. Since the backwater, as mentioned above, is used to correct the density of the split streams, this naturally also has an effect on it.

An important finding, however, is the following: while the stock density of the backwater changes after passing through the screen at a specific point, the stock density of the backwater initially remains unchanged at the location at which backwater is removed from the backwater tank, over the entire period. This also means that backwater of the "incorrect" stock density is supplied the entire time to the main streams coming from the distributor.

If according to the invention, the dilution water line is instead connected directly to the collection trough, this means that during a change in the retention and thus in the stock density of the dilution water the latter directly reaches the split stream lines with the "correct" stock density.

This can be explained on the following example: if for any reason retention decreased over a short period and thus more fines and more fillers reach the backwater, then the water has a higher stock density. Precisely this backwater is fed at practically the same instant and thus uniformly increases the fines and filer content in the nozzle space over the width of the machine. This increase in stock density compensates for the lower retention. A highly dynamic self-regulating effect therefore exists. The system is therefore amazingly simple in that it consists in practice of more full recycling of the backwater.

The invention is further explained with reference to the drawing which shows a wet part of a paper machine. The following elements are apparent from FIG. 1: A distributor 1 with a vertical longitudinal axis has a connection 1.1 to a supply of a main stream of stock suspension. This main stream comes from a stock preparation unit (not shown). In the embodiment shown in FIG. 1 the distributor has a circular cross section.

The distributor 1 also has a plurality of connections that are situated in the same plane. In the embodiment shown in FIG. 1 only connections 1.2 and 1.3 can be seen. A hose line is lead away from each connection (see hose lines 1.22, 1.33, 1.44 and 1.55). These hose lines are brought to a machine-wide flow box 2 having corresponding connectors 2.2, 2.3, 2.4 and 2.5, as well as a slice nozzle 2.1 on the outlet side as shown in FIG. 2.

The hose lines 1.22, 1.33, 1.44 and 1.55 are much more numerous in practice than shown here and expediently all have the same length. The inlet connectors to the nozzle chamber 2 also are situated in the same horizontal plane and preferably have the same mutual spacing.

Figure 2:
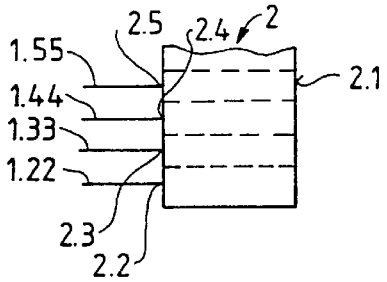
FIG. 2 is an enlarged view of a portion of the apparatus of claim 1.

The nozzle chamber 2 can have partitions in its interior, which are shown in FIG. 2 with dashed lines, and which lie in vertical planes. If provided, they extend either over the entire length of the nozzle chamber 2 or only over part of it.

A screen part 3 shown in FIG. 1 includes in known fashion a longitudinal screen 3.1, a breast roll 3.2, an idle roll 3.3 and a plurality of guide rolls 3.4.

In principle, combination of the apparatus according to the invention with a hybrid former or a double-screen former is possible.

A collection trough 4, as well as a backwater tank 5 are situated beneath the longitudinal screen 3.1. The trough 4 and tank 5 join so that the water drained through the screen 3.1 during the papermaking process reaches the collection trough 4 and thus also the backwater tank 5.

The backwater, as is known, is used to dilute the main stream of the pulp suspension. In the present case it is led away according to the invention at a specific location of the collection trough, the connection site 4.1. The water drain occurs by means of a pump 6 to which a pressure line 6.1 is connected. The pressure line 6.1 branches into lines 6.2, 6.3, 6.4 and 6.5. The line 6.2 discharges into the hose line 1.22, the line 6.3 into the hose line 1.33, the line 6.4 into the hose line 1.44 and the line 6.5 into the hose line 1.55.

As is further apparent, the branch lines of the backwater, namely lines 6.2, 6.3, 6.4 and 6.5, contain valves with which inflow of the backwater serving for dilution to the hose lines 1.22, 1.33, 1.44 and 1.55 can be adjusted in controllable fashion. Also valves can optionally (in addition) be provided in the hose lines. The individual split streams fed into the hose lines thus reach the flow box 2, in which case they have precisely the correct fiber content.

Because of the position of the connection site 4.2, according to the invention the backwater is guided to the sites of consumption in a very tight circulation. Control is very rapid, i.e., without a significant time delay, so that one can speak of a dynamic self-regulation effect.

In addition to connection of the dilution water lines directly to the collection trough, also according to the invention, the dilution water lines and/or the split stream lines of the main and/or mixed stream have connections 10 for introduction of chemicals, like retention agents, or additional pulp suspensions or screened stock suspensions.

A combination of direct connection between the trough and the dilution water lines and various connections for the introduction of other materials with subconcepts is also possible.

Longitudinal profile fluctuations, i.e., fluctuations in time, can be compensated for either by the self-regulation effect of flowing dilution water directly from the collection trough to the split stream lines (first concept of the invention), or by addition of retention agents according to the second concept of the invention.

If retention agents are added according to the second concept of the invention, this occurs for the following reasons: the retention agent must preferably be connected with those components that have poor retention behavior; high screened stock and filler fractions are present in the backwater stream.

This offers better control behavior during addition of retention agents to the backwater stream. The transient times of the control process become shorter and less retention agent need be added to achieve a certain retention.

Addition of the retention agent preferably occurs in relation to screened stock and filler in the main stream and in the dilution stream in the main and dilution water streams. The control behavior can be deliberately influenced by departing from this distribution or by varying the absolute amount. The backwater stock density, the main stream stock density, the split stream stock density, or the mathematical combination of the two stock densities can be used as a measured quantity.

Apparatus according to the invention can be used in paper making machine wet parts in which two or more distributors are connected to a single nozzle chamber in a multilayer headbox. It is also possible to use apparatus of the invention in multilayer headboxes in which a first pulp layer is initially formed, onto which a second layer, produced by a secondary headbox is applied, etc.

The foregoing detailed description is given for clearness of understanding only, and no unnecessary limitations should be understood therefrom, as modifications within the scope of the invention will be apparent to those skilled in the art.

We claim:

1. A wet part of paper making machine comprising:

(a) a distributor, to which a main stream of stock suspension is fed, the distributor having a plurality of connections;

(b) a machine-wide flow box having a machine-wide headbox slice nozzle;

(c) a plurality of split stream lines, each line connected to one of the plurality of connections of the distributor and to the machine-wide flow box, the split stream lines connected to the flow box;

(d) at least one continuous web-forming screen, the slice nozzle positioned with respect to the screen to deposit stock suspension from the slice nozzle onto the screen;

(e) at least one collection trough disposed with respect to the screen to collect backwater separated from the stock suspension deposited on the screen, the collection trough having a collection portion and a backwater storage portion, the collection portion including a first end, a second end and a bottom, wherein the bottom is slanted from the first end toward the second end and wherein the backwater storage portion is formed in the second end;

(f) a connection site disposed at a specific location on the collection portion; and (g) a plurality of dilution water lines for introducing the backwater directly from the connection site into the split stream lines to adjust the stock density of the split streams, the dilution water lines being connected directly to one of (i) the connection site of the collection trough and (ii) a line system attached directly to the connection site of the collection trough.

2. A wet part of a paper making machine comprising:

(a) a distributor, to which a stream of stock suspension is fed, the distributor having a plurality of connections;

(b) a machine-wide flow box having a machine-wide headbox slice nozzle;

(c) a plurality of split stream lines, each line connected to one of the plurality of connections of the distributor and to the machine-wide flow boy, the split stream lines connected to the flow box;

(d) at least one continuous web-forming screen, the slice nozzle positioned with respect to the screen to deposit stock suspension from the slice nozzle onto the screen;

(e) at least one collection trough disposed with respect to the screen to collect backwater separated from the stock suspension deposited on the screen, the collection trough having a collection portion and a backwater storage portion, the collection portion including a first end, a second end and a bottom wherein the bottom is slanted from the first end toward the second end and wherein the backwater storage portion is formed in the second end;

(f) a connection site disposed at a specific location on the collection portion; and (g) a plurality of dilution water lines for introducing the backwater directly from the connection site into the split stream lines to adjust the stock density of the split streams, the dilution water lines being connected directly to one of (i) the connection site of the collection trough and (ii) a line system attached directly to the connection site of the collection trough, at least one of the dilution water lines, the main stream line, and the split stream fines having connections from the introduction of at least one of chemicals, retention agents, additional pulp suspensions, and screened stock suspensions.

3. The wet part according to claim 2 further comprising means for controlling the introduction of the at least one of chemicals, additional pulp suspensions, and screened stock suspensions.

4. The wet part of claim 3 further comprising means for measuring at least one of the backwater stock density, the main stream stock density, the split stream stock density, and combinations thereof.

* * * * *